United States Patent [19]

Manduley et al.

[11] Patent Number: 4,724,959

[45] Date of Patent: Feb. 16, 1988

[54] MAILER FOR DELIVERY OF REPLACEMENT UNITS AND RETURN OF REPLACED UNITS

[75] Inventors: Flavio Manduley, Woodbury; Norman R. Lilly, Stratford, both of Conn.

[73] Assignee: Pitney Bowes Inc., Stamford, Conn.

[21] Appl. No.: 787,345

[22] Filed: Oct. 15, 1985

[51] Int. Cl.[4] ..... B65D 73/02

[52] U.S. Cl. ..... 206/334; 206/525; 206/527

[58] Field of Search ..... 206/334, 525, 527

[56] References Cited

U.S. PATENT DOCUMENTS

| | | | |
|---|---|---|---|
| 4,494,651 | 1/1985 | Malcolm | 206/334 |
| 4,527,222 | 7/1985 | Swingley, Jr. | 206/334 |
| 4,563,722 | 1/1986 | Maroney et al. | 206/334 |
| 4,574,959 | 3/1986 | Hollett | 206/334 |

*Primary Examiner*—Joseph Man-Fu Moy

*Attorney, Agent, or Firm*—Gerald E. Linden; David E. Pitchenik; Melvin J. Scolnick

[57] ABSTRACT

A mailer for the delivery of replacement units and the return of replaced units. Preferably the units include electronic components such as PROM's mounted on printed circuit boards. A replacement unit is held within the mailer by a restraint in a position such that an address for a customer to whom the replacement unit is to be delivered affixed to the replacement unit is visible through a window in the mailer. Insertion of a replaced unit into the mailer causes the restraint to release the replacement unit and secure the replaced unit in such a position that no address is visible through the window. Accordingly, the mailer would be returned to the vendor whose address is imprinted on the mailer with no need for further effort on the part of the customer. In one embodiment of the disclosed invention, where the units are PROM modules mounted on printed circuit boards, when the replaced unit is partially inserted into the mailer the mailer may then be used as an extraction tool to remove the replaced unit from an edge connector, and when the replaced unit is fully inserted into the mailer the mailer maybe used as an insertion tool to insert the replacement unit into the edge connector.

20 Claims, 9 Drawing Figures

MAILER FOR DELIVERY OF REPLACEMENT UNITS AND RETURN OF REPLACED UNITS

BACKGROUND OF THE INVENTION

This invention relates to a method and apparatus for delivery of replacement units and return of the replaced units. More particularly, it relates to a method and apparatus for delivery of replacement units which comprise electronic components such as PROM's mounted on printed circuit boards to form modules, and for return of such modules.

Postal scales and the like are well known. Such scales determine the weight of items to be mailed and from this weight, together with information which may be input by an operator, determine the charges for mailing the item in accordance with rates stored in the scale. Typically, such scales are controlled by a microprocessor and rates for the USPS and/or other carriers such as UPS are stored in the processor memory. The operation of such postal scales is well known and need not be described further here for an understanding of the subject invention.

Typically, PROM's are used as the rate memory for such postal scales. PROM's offer several advantages for this purpose. They are non-volatile, which allows easy delivery of new rates to customers, and they are easily programmable so that new rate memories may be manufactured quickly in the event of a rate change. PROM's are also relatively expensive and reusable and it is a considerable savings to vendors of postal scales if they can obtain the return of the old replaced PROM's from their customers when rates are changed. Some vendors will impose a substantial charge on their customers who fail to return the PROM's while others, for marketing reasons, will absorb the cost of unreturned PROM's themselves.

With the proliferation of private courier type carriers and the expected increase in the frequency of rate changes, it is apparent that the costs of this problem can be expected to increase in the future.

Accordingly, it is an object of the present invention to provide apparatus whereby replacement units maybe delivered to a customer and replacement units returned to the vendor; in particular, where such units are PROM modules used in postal scales or the like.

It is another object of the subject invention to provide apparatus which minimize the efforts of a customer while facilitating and encouraging return of the replaced units.

It is another object of the subject invention to provide apparatus whereby the replacement units may be delivered through the mails and the replaced units returned through the mails without need for the customer to address the replaced units before returning them.

BRIEF SUMMARY OF THE INVENTION

The above objects are achieved and the disadvantages of the prior art are overcome in accordance with the present invention by a mailer for delivery of replacement units and return of replaced units. The mailer includes a housing having an opening for insertion of the replaced unit, and a restraint which holds the replacement unit within the housing and responds to insertion of the replaced unit to release the replacement unit and hold the replaced unit within the housing.

In a preferred embodiment of the present invention, the replacement unit has the address to which the unit is to be delivered affixed to its surface and the housing includes a window which allows the address to be seen.

In another preferred embodiment of the subject invention, the return address of the vendor is affixed to the surface of the mailer and when the replaced unit is inserted into the mailer, it is held in a position such that any address affixed to its surface cannot be seen through the window. Thus, the only address visible once the replaced unit is inserted into the mailer is the return address and the customer does not need to address the mailer before returning it.

The present invention is used by a customer who receives a replacement unit contained in a mailer, the unit being, held in the mailer by a restraint, and inserts the replaced unit into the mailer to release the replacement unit and hold the replaced unit within the mailer. The customer then removes the released replacement unit from the mailer, replaces the replaced unit, and returns the mailer with the replaced unit to a recipient.

All of the above embodiments are preferred for use with units which include electronic components, such as PROM's, mounted on a printed circuit board. Thus, the apparatus of the present invention advantageously achieve the above objects since the customer, in the very act of releasing the replacement unit from the mailer, prepares the replaced unit for return to the vendor.

Other objects and advantages of the present invention will be apparent to those skilled in the art from the attached drawings and the detailed description of preferred embodiments set forth below. Those skilled in the art will also recognize that though the present invention has been described above in terms of customers and vendors, these terms are not intended to imply a buyer/seller relationship or to exclude the involvement of third parties.

DETAILED DESCRIPTION OF PREFERRED EMBODIMENTS OF THE SUBJECT INVENTION

Figure 1:
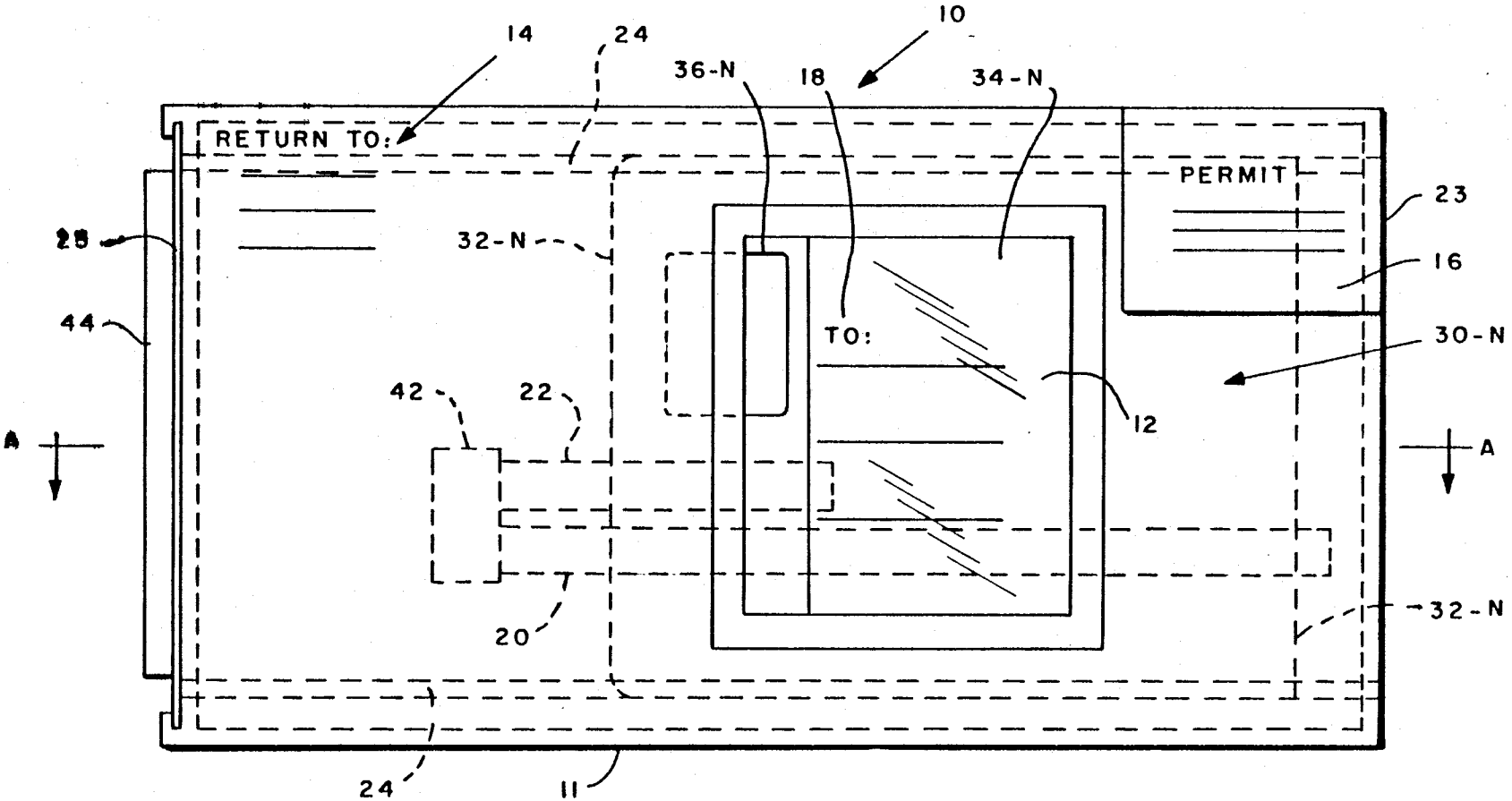
FIG. 1 shows a plan view of a mailer in accordance with the subject invention containing a PROM module shown in phantom.

FIG. 1 shows a plan view of a mailer 10 which contains a replacement PROM Module 30-N, shown in phantom. Mailer 10 includes a housing 11 which is preferably a unitary piece formed from a high strength plastic. Housing 11 includes a window covered by a transparent resiliant material 12 through which address label 18 affixed to PROM 34-N may be seen. Indicia 14 representing a return address are affixed to the surface of housing 11 and other indicia 16 representing a mailing permit are also affixed to the surface of housing 11.

Figure 2:
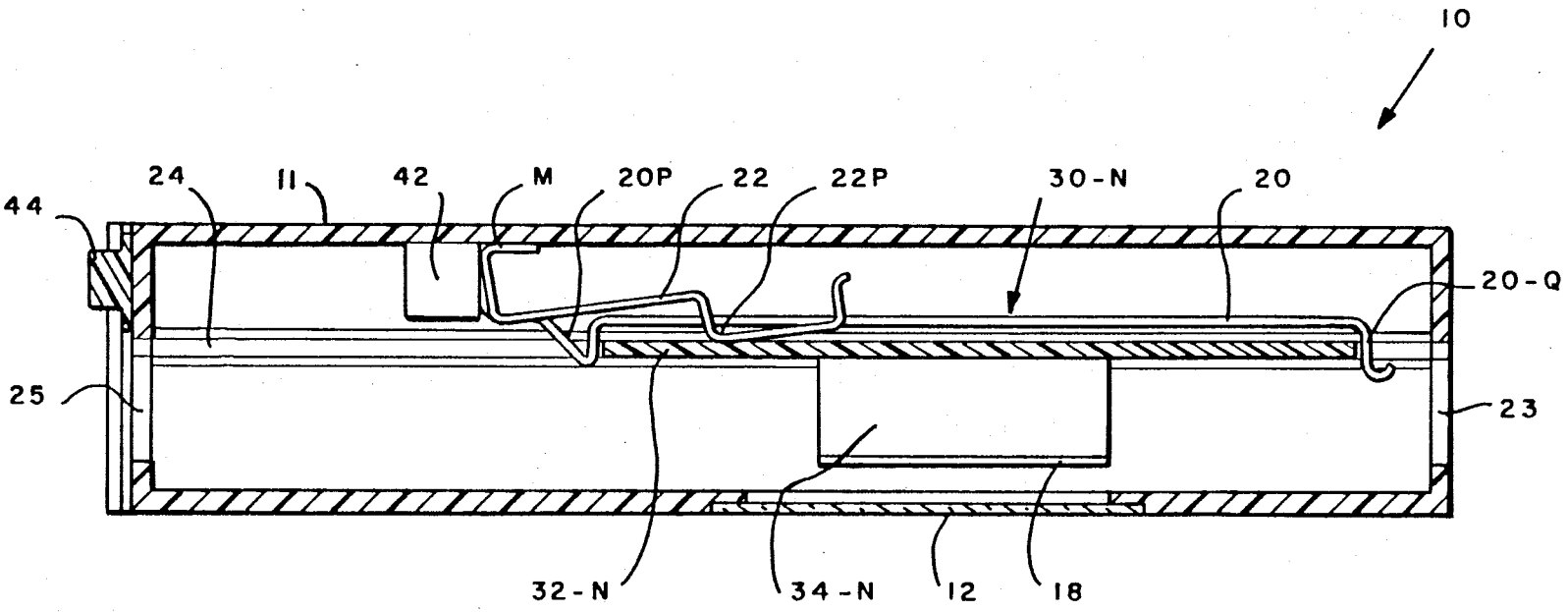
FIG. 2 is a cross-section view of the mailer of FIG. 1 taken along line A—A.

Other elements of the preferred embodiment of the subject invention may be understood more clearly by reference to the cross-section view of FIG. 2. PROM Module 32-N is held in position beneath window 12 by a restraint which includes guides 24 and spring clips 20 and 22. Printed circuit board 32-N fits into guide 24 to restrain module 30-N vertically while projections 20P and 20Q of spring clip 20 position module 30-N horizontally. Horizontal support is also partially provided by friction between printed circuit board 32-N and spring clip 22.

Openings 23 and 25 in housing 11 allow insertion of a replaced module and removal of replacement module 30-N and stop 42 and slide 44 provide support during the replacement process; as will be more fully described below. Aperture 36-N in printed circuit board 32-N is used when module 30-N is, in turn, replaced; as will be more clearly seen in the description of the replacement process set forth below.

Figure 3A:
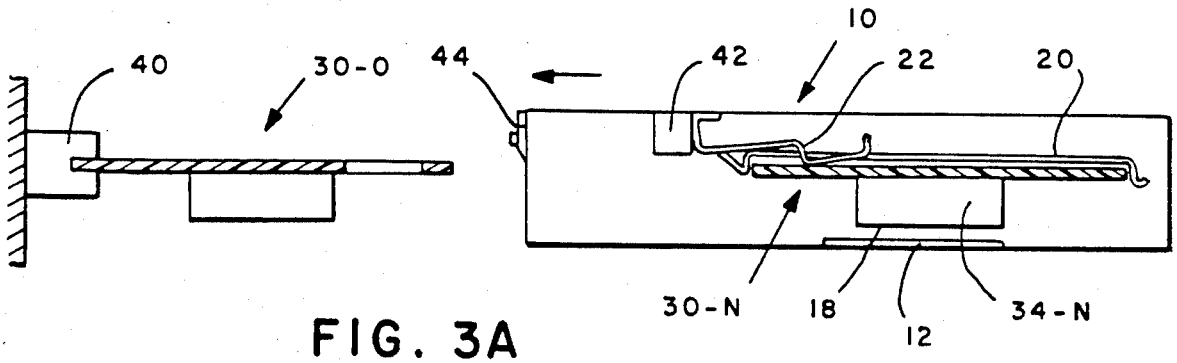
FIGS. 3A through 3G are semi-schematic cross-section representations of steps involved in a method of using the mailer of the subject invention.
Figure 3B:
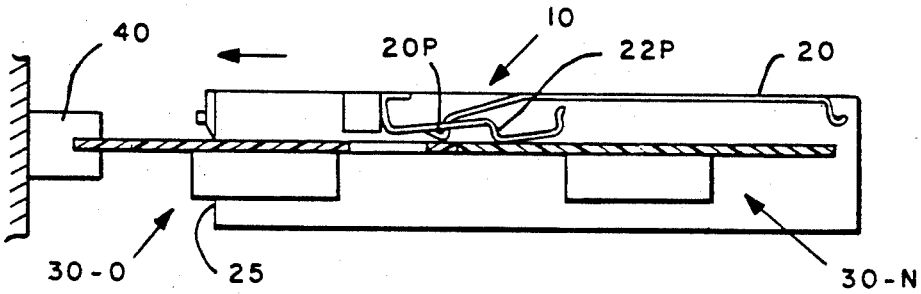
Figure 3C:
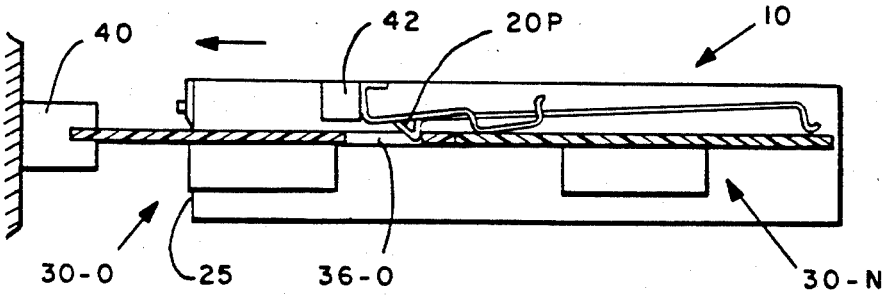
Figure 3D:
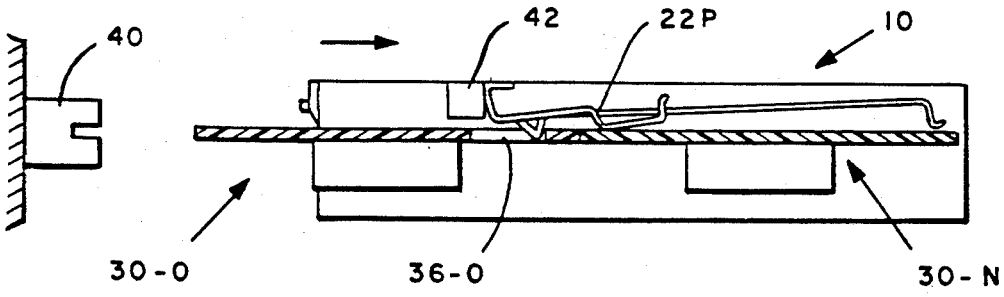

Turning to FIGS. 3A through 3G, the replacement and return process in accordance with the subject invention are shown in schematic form. A vendor who wishes to provide a customer with replacement PROM modules affixes an appropriate address label 18 to replacement module 30-N and secures module 30-N in mailer 10 as described above. Since the customers address is visible through window 12 the vendor need only deposit mailer 10 with the USPS, or other carrier for delivery to the customer. As shown in FIG. 3A, the customer will receive module 10 and replacement module 30-N. Replaced module 30-O is connected to the customer's system by edge connector 40. Module 30-O is inserted into mailer 10 through opening 25 until it bears upon projection 20P of spring clip 20. Continued pressure on projection 20P then deflects spring clip 20 releasing module 30-N, as shown in FIG. 3B. As shown in FIG. 3C, continued movement of mailer 10 to the left (i.e., towards edge connector 40) displaces module 30-N and allows projection 20P to engage aperture 36-O.

As shown in FIG. 3-D, once projection 22P engages aperture 36-O force maybe applied to mailer 10 and through projection 22P to module 30-O to disconnect module 30-O from edge connector 40. As module 30-O is being removed from edge connector 40, stop 42 prevents spring 22 from bending backwards and possibly releasing projection 22P from aperture 36-O.

Figure 3E:
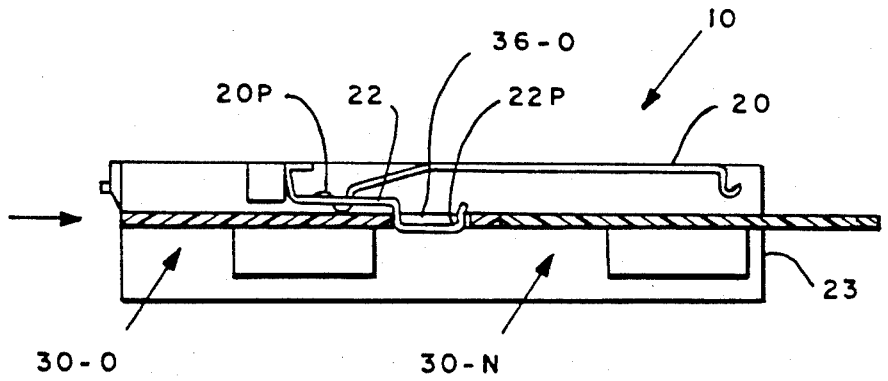

As can be seen in FIG. 3E, once module 30-O is released from edge connector 40 it maybe completely inserted into mailer 10, disengaging projection 20P from aperture 36-O and allowing projection 22P to engage aperture 36-O; securing module 30-O within mailer 10. As also may be seen in FIG. 3E, complete insertion of module 30-O further displaces 30-N causing it to project through opening 23.

Figure 3F:
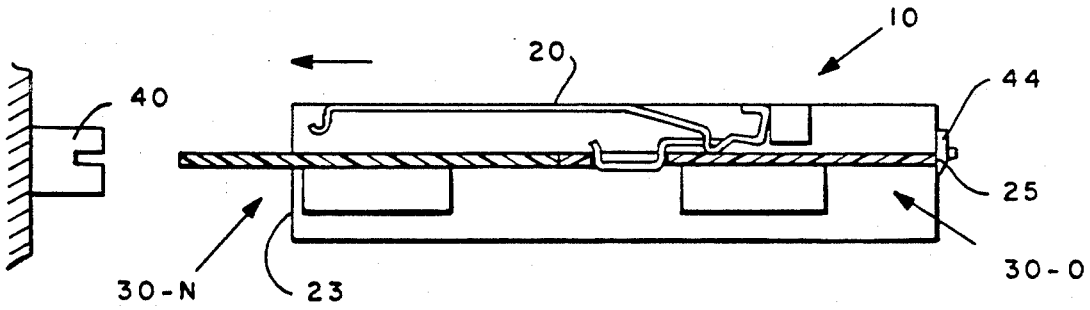

In FIG. 3F, mailer 10 is shown rotated 180° so that module 30-N is adjacent to edge connector 40. Mailer 10 maybe then used to insert module 30-N into edge connector 40. Slide 44 is closed over opening 25 to support modules 30-O and 30-N against the force needed to insert module 30-N into edge connector 40.

Figure 3G:
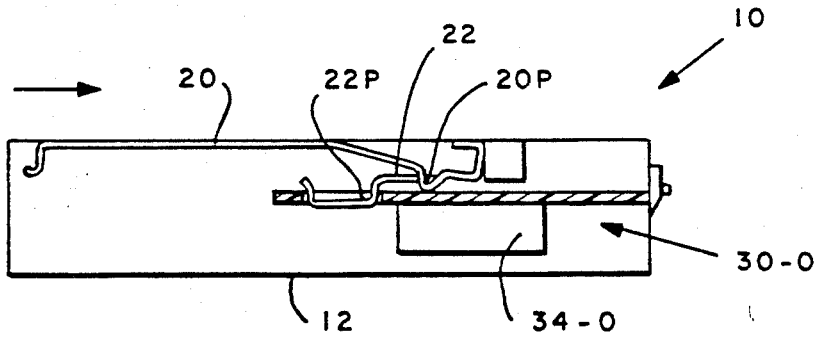

As shown in FIG. 3G, mailer 10 may then simply be removed leaving module 30-N in edge connector 40. Module 30-O is secured within mailer 10 by spring clip 22 in a position such that any address remaining on the surface of PROM 34-O is no longer visible through window 12. Thus, when mailer 10 is deposited with the USPS, or other carrier, it will be returned to the vendor at the return address printed on mailer 10.

Thus it maybe seen that the apparatus of the subject invention provide an effective way in which replacement units maybe delivered to and replaced units returned from a customer with minimal effort or involvement on the part of the customer. Those skilled in the art will, however, realize that the preferred embodiments described above have been provided by way of illustration only and other embodiments in accordance with the subject invention will be apparent to them from consideration of the teachings set forth above and the attached drawings. Accordingly, limitations on the scope of the subject invention are to be found only in the claims set forth below.

What is claimed is:

1. A mailer for containing for delivery a replacement unit and for containing for return a replaced unit, comprising:
   (a) housing means for containing a replacement unit and for receiving by insertion a replaced unit; and
   (b) restraining means for releasably holding the replacement unit within the housing means, for releasing the replacement unit when a replaced unit is inserted into the housing means, and for holding the replaced unit within the housing means.

2. A mailer as described in claim 1 wherein said units each comprise a printed circuit board.

3. A mailer as described in claim 1 wherein:
   (a) first indicia representative of the address to which said replacement unit is to be delivered are affixed to the surface of said replacement unit;
   (b) said housing means includes a window; and,
   (c) said restraining means holds said replacement unit positioned so that said indicia may be seen through said window.

4. A mailer as described in claim 2 wherein:
   (a) first indicia representative of the address to which said replacement unit is to be delivered are affixed to the surface of said replacement unit;
   (b) said housing means includes a window; and,
   (c) said restraint restraining means holds said replacement unit positioned so that said indicia may be seen through said window.

5. A mailer as described in claim 3 wherein said restraining means holds said replaced unit in said first position after complete insertion of said replaced unit so that indicia affixed to the surface of said replaced unit in substantially the same way said first indicia are affixed to said replacement unit are not visible through said window.

6. A mailer as described in claim 4 wherein said restraining means holds said replaced unit in said first position after complete insertion of said replaced unit so that indicia affixed to the surface of said replaced unit in substantially the same way said first indicia are affixed to said replacement unit are not visible through said window.

7. A mailer as described in claim 5 wherein second indicia representative of the address to which said replaced unit is to be returned are affixed to the surface of said housing.

8. A mailer as described in claim 6 wherein second indicia representative of the address to which said replaced unit is to be returned are affixed to the surface of said housing.

9. A mailer as described in claim 1 wherein said restraining means comprises a spring wire clip for engaging said replacement unit.

10. A mailer as described in claim 2 wherein said restraining means comprises a spring wire clip for engaging said replacement unit.

11. A mailer as described in claim 9 wherein said spring wire clip includes a projection; said projection being so positioned that, when said spring wire clip engages said replacement unit, said replaced unit will, when partially inserted into said housing means, bear upon said projection; and so shaped that force applied to said projection by said inserted replaced unit will deflect said spring wire clip and release said replacement unit.

12. A mailer as described in claim 10 wherein said spring wire clip includes a projection; said projection being so positioned that, when said spring wire clip engages said replacement unit, said replaced unit will, when partially inserted into said housing means, bear upon said projection; and so shaped that force applied to said projection by said inserted replaced unit will deflect said spring wire clip and release said replacement unit.

13. A mailer as described in claim 2 wherein said restraining means responds to partial insertion of said replaced unit to hold said replaced unit in a second position and support said replaced unit against tension loads in said printed circuit board, whereby said mailer may be used as an extractor to remove said replaced unit from an edge connector.

14. A mailer as described in claim 2 wherein said restraining means responds to complete insertion of said replaced unit to hold said replaced unit in said first position and to support said replaced unit against compression loads in said printed circuit board; and wherein further complete insertion of said replaced unit displaces said replacement unit so that the connecting fingers of said printed circuit board of said replacement unit project from said housing means, whereby said mailer may be used as an insertion tool to insert said replacement unit into said edge connector.

15. A mailer as described in claim 5 wherein said restraining means responds to complete insertion of said replaced unit to hold said replaced unit in said first position and to support said replaced unit against compression loads in said printed circuit board; and wherein further complete insertion of said replaced unit displaces said replacement unit so that the connecting fingers of said printed circuit board of said replacement unit project from said housing, whereby said mailer may be used as an insertion tool to insert said replacement unit into said edge connector.

16. A mailer as described in claim 13 wherein said restraining means responds to complete insertion of said replaced unit to hold said replaced unit in said first position and to support said replaced unit against compression loads in said printed circuit board; and wherein further complete insertion of said replaced unit displaces said replacement unit so that the connecting fingers of said printed circuit board of said replacement unit project from said housing means, whereby said mailer may be used as an insertion tool to insert said replacement unit into said edge connector.

17. A mailer as described in claim 5 wherein said restraining means responds to complete insertion of said replaced unit to hold said replaced unit in said first position and to support said replaced unit against compression loads in said printed circuit board; and wherein further complete insertion of said replaced unit displaces said replacement unit so that the connecting fingers of said printed circuit board of said replacement unit project from said housing means, whereby said mailer may be used as an insertion tool to insert said replacement unit into said edge connector.

18. A mailer as described in claim 17 wherein said restraining means responds to complete insertion of said replaced unit to hold said replaced unit in said first position and to support said replaced unit against compression loads in said printed circuit board; and wherein further complete insertion of said replaced unit displaces said replacement unit so that the connecting fingers of said printed circuit board of said replacement unit project from said housing means, whereby said mailer may be used as an insertion tool to insert said replacement unit into said edge connector.

19. A mailer as described in claim 1 further comprising guides for constraining the motion of said units during insertion and removal.

20. A mailer as described in claim 2 further comprising guides for constraining the motion of said units during insertion and removal.

* * * * *